US005156281A

United States Patent [19]

Schwartz

[11] Patent Number: 5,156,281

[45] Date of Patent: - Oct. 20, 1992

[54] LOCKING MECHANISM FOR BRACKETLESS EXTENSION RODS

[75] Inventor: Frederick Schwartz, Merion Station, Pa.

[73] Assignee: Zenith Products Corp., Aston, Pa.

[21] Appl. No.: 673,889

[22] Filed: Mar. 22, 1991

[51] Int. Cl.[5] ..... A47H 1/08

[52] U.S. Cl. ..... 211/105.3; 403/104; 403/106; 403/109; 248/298

[58] Field of Search ..... 211/105.3; 160/138; 410/145, 149, 151; 403/104, 106, 107, 109, 326; 248/298; 16/95 D

[56] References Cited

U.S. PATENT DOCUMENTS

| | | | |
|---|---|---|---|
| 420,486 | 2/1890 | Wyant | 211/105.3 |
| 520,584 | 5/1984 | Turner | 211/105.4 |
| 1,357,714 | 11/1920 | Lane | 403/104 |
| 1.447,519 | 3/1923 | Schade | 403/105 |
| 1.611,057 | 12/1926 | Neil | 403/104 |
| 1.646,049 | 10/1927 | Boye | 248/298 X |
| 1.679,881 | 8/1928 | Simpson | 211/105.4 |
| 1.756,716 | 4/1930 | Whitney | 211/105.3 |
| 2,509,521 | 5/1950 | Pegram | 211/105.3 |
| 2.883,219 | 4/1959 | Cox | 287/58 |
| 3,222,095 | 12/1965 | Gerus | 287/2 |
| 3,674,294 | 7/1972 | Kirkham | 287/58 CT |
| 4,032,232 | 6/1977 | Perther | 248/298 X |
| 4,720,222 | 1/1988 | Nagy et al. | 410/141 |
| 4,824,062 | 4/1989 | Wagner | 248/265 |
| 4,848,432 | 7/1989 | Connolly | 160/178.1 |
| 4,895,471 | 1/1990 | Gelty et al. | 403/104 |

*Primary Examiner*—Carl D. Friedman
*Assistant Examiner*—Korie H. Chan
*Attorney, Agent, or Firm*—Panitech, Schwarze, Jacobs & Nadel

[57] ABSTRACT

A bracketless extension rod includes a locking mechanism for holding the rod in place between two opposing support surfaces. The rod includes an inner rod section telescopingly fitted within channel means formed on a outer rod section. The locking mechanism includes a locking plate slidably received within the channel means and a tang means affixed to the locking plate. An extendable lever mechanism is attached to the inner rod section and to the locking plate. The tang permits the rod sections to move only in the direction of extension of the rod by engagement with opposing walls of the channel means. When extended, the lever mechanism places the rod in compression between two opposing supporting surfaces.

11 Claims, 2 Drawing Sheets

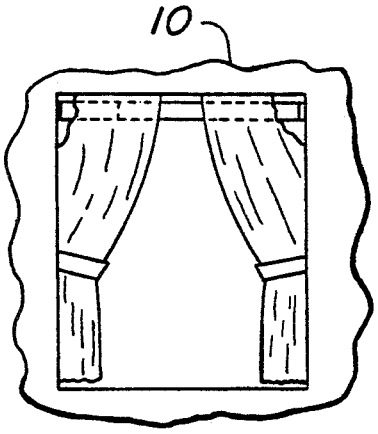
FIG. 1
FIG. 4
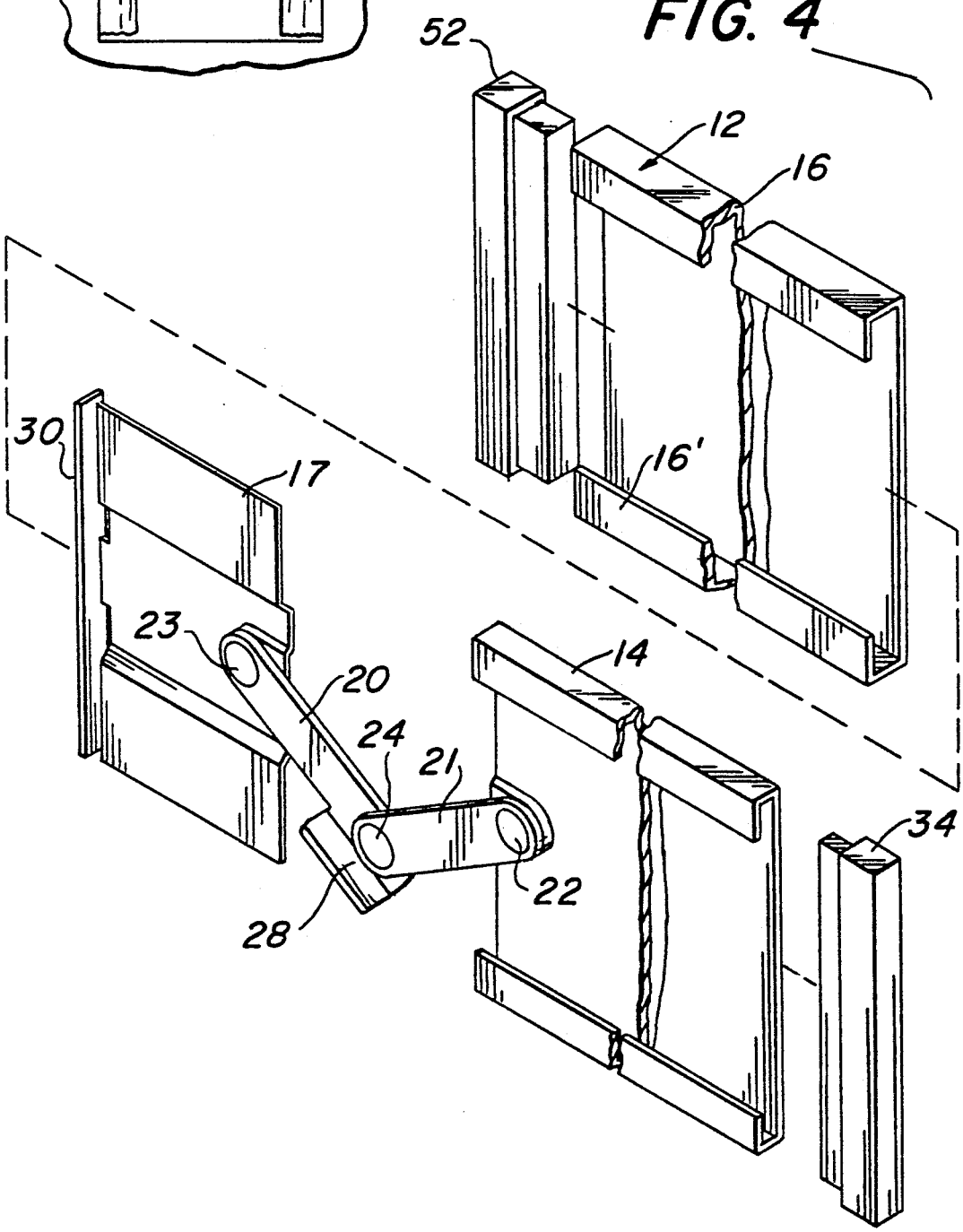

LOCKING MECHANISM FOR BRACKETLESS EXTENSION RODS

BACKGROUND OF THE INVENTION

The present invention relates to a locking mechanism for bracketless extension rods. This invention is particularly suited for use with a flat bracketless extension rod, such as expandable curtain, drapery or closet rods, but is by no means limited to such applications.

The concept of a bracketless rod which can be adjusted for various lengths is well-known. A first rod is inserted (telescope-like) into a larger second rod section, and once inserted, is adjusted to the length desired. Previously, this has been done by anchoring the opposite ends of the first and second rod sections against opposite walls or by using elaborate and complicated locking elements within the rods that may be difficult to install.

One known system for a flat bracketless rod uses two flat plates separated and attached to each other by a spring or biasing means where the first plate is fitted within one rod section. The first plate is adjustably kept in place by two screws and accompanying lock washers which pinch the rolled edges of the rod sections. The second plate, which is attached to the first plate by the spring means, is then inserted into the same rod section where it abuts the end edge of the second rod section fitted within the first rod section. The first plate is locked into place by tightening the screws to pinch the edges of the first rod section. Tension is attained by locking the first plate on the first rod section, so that the overall length of the two rod sections is approximately a half an inch greater than the surfaces between which the rod is to be installed. Subsequently compressing the second, inner section against the second plate will allow the rod to fit between the surfaces. However, it may be cumbersome to install such a rod because of the necessity for properly determining the overall rod length and then to properly screw or tighten the first plate into place.

The present invention utilizes a mechanism which permits for easy adjustment of the extension between the first and second rod sections, and for readily securing the first and second rod sections into place once the sections are at a desired length.

SUMMARY OF THE INVENTION

Briefly stated, the present invention comprises a locking mechanism for bracketless extension rods, particularly flat extension rods. The locking mechanism includes inner and outer telescoping rod sections in which the outer rod section includes channel means for receiving the inner rod section. The channel means includes at least two folded opposed walls of the outer rod section. A locking plate slides within the channel means and has a tang means affixed to it. The tang means permits the locking plate to move relative to the outer rod section only in the direction of extension of the rod by engaging the folded opposed walls included in the channel means. Attached to the locking plate is an extendable lever mechanism which is also attached to the inner rod section. The lever mechanism is operable when extended to place the rod in compression between two opposed support surfaces.

BRIEF DESCRIPTION OF THE DRAWINGS

For the purpose of illustrating the invention, there is shown in the drawings a form which is presently preferred; it being understood, however, that this invention is not limited to the precise arrangement and instrumentality shown. In the drawings:

FIG. 1 is an illustration of the bracketless extension rod of the present invention being used as a curtain rod;

FIG. 4 is an exploded view of the bracketless extension rod.

DESCRIPTION OF PREFERRED EMBODIMENT

Figure 2:
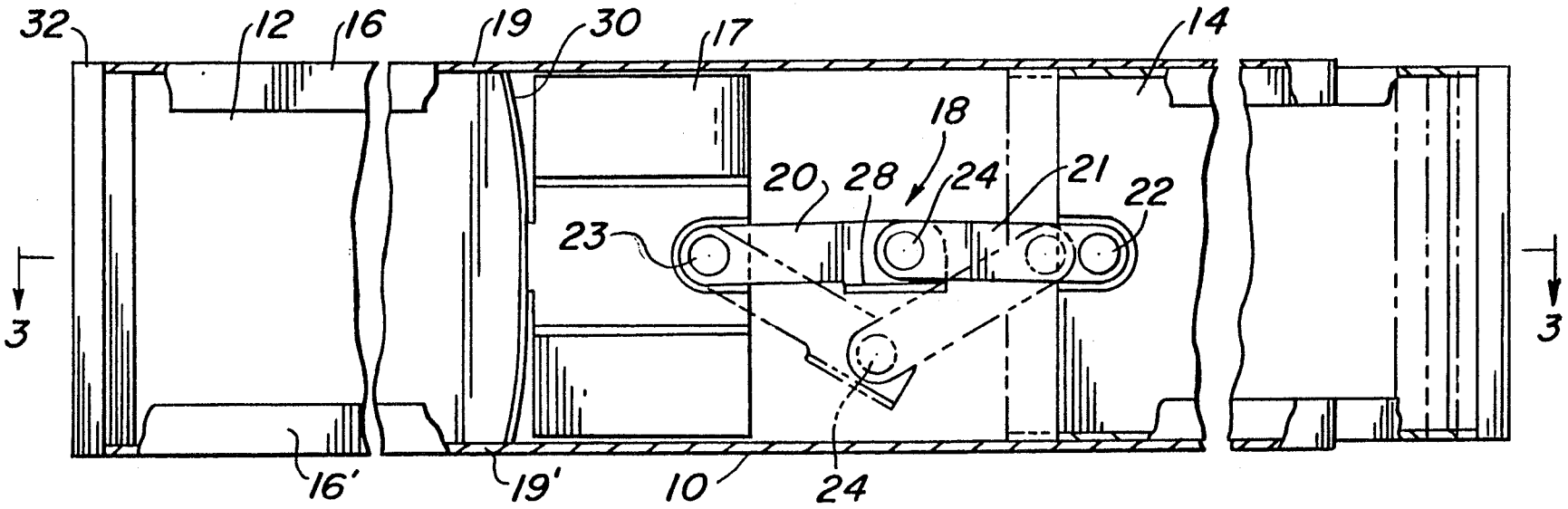
FIG. 2 is a sectional view of the rod showing the lever mechanism in both locked and unlocked positions.
Figure 3:
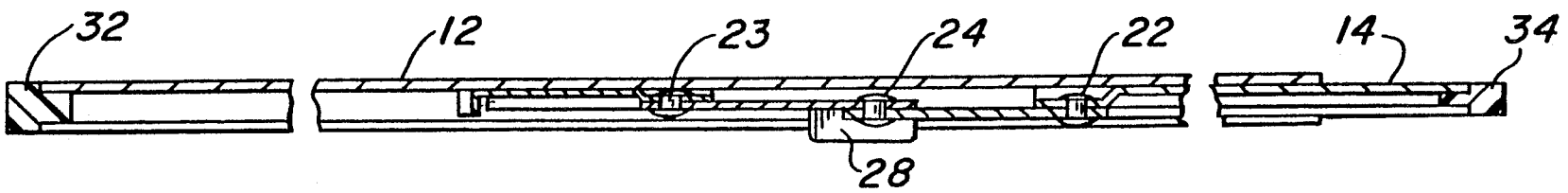
FIG. 3 is a fragmentary sectional view taken along line 3—3 in FIG. 2.

Referring to the drawings wherein like numerals indicate like elements, there is shown in FIG. 1 an example of a flat bracketless extension rod 10 being used as a curtain rod. FIG. 2 illustrates a preferred form of the flat bracketless extension rod 10 as being comprised of outer and inner telescoping sections 12 and 14. The outer section 12 comprises upper and lower folded walls 16, 16' which form a channels that allow the inner rod section 14 to be inserted and guided into the outer rod section 14 in a telescoping manner.

A lever mechanism 18 is attached, preferably pivotably, to the inner rod section 14 and to a locking plate 17, preferably a spring locking plate, by means of fastening devices 22 and 23, respectively. The fastening devices 22 and 23 preferably are pins for allowing pivotable movement. The lever mechanism 18 is comprised of two equal-sized lever arms 20 and 21 pivotably attached to one another by a fastening pin 24. Arm 21 is pivotably attached to the inner rod section 14 by fastening pin 22 and arm 20 is pivotably attached to the spring locking plate 17 by fastening pin 23. The fastening pins 22, 23 and 24 allow the lever mechanism 18 to be positioned in either an extended position (shown in full line in FIG. 2) or in a nonextended position (shown in dotted line in FIG. 2) whereby the arms 20 and 21 form an angle around the fastening pin 24. A thumb piece 28 is also formed on the arm 20. The thumb piece 28 allows the user to press the lever mechanism 18 into the extended position and also provides a stop by engaging the arm 21 as shown.

The spring locking plate 17 is slidingly positioned in the outer rod section 12 within the channel defined by the folded walls 16, 16'. The spring locking plate 17 has attached to it a deformable spring 30. The spring 30 is of a greater length than the inside width between the upper and lower side walls 19, 19' thereby forming locking tangs. When the inner rod section 14 and the spring locking plate 17 are inserted into the outer rod section 12, the spring 30 deforms into a generally concave configuration (facing away from the plate 17) whereby the tang-like ends of spring 30 engage the side walls 19, 19'. The deformation of the spring 30 into a generally concave configuration results in the spring locking plate 17 being unable to be pushed in the opposite direction from the direction of its insertion (e.g. to the left in FIG. 2).

The spring 30 limits the spring locking plate 17 to one direction of movement; that is the direction of extension. Once the user of the rod 10 determines the length of rod 10, the lever mechanism 18 can be extended fully and locked into place by forcing the locking plate 17 against the spring 30 to put the rod 10 in compression. The rod 10 is in compression because the ends of the rod 10 will already be in contact with the respective wall surfaces prior to placing the lever mechanism 18 into an extended position. When the rod 10 is extended between opposite support surfaces and the lever mechanism 18 is in an nonextended position, a small amount of displacement against the spring 30 remains present in the locking plate 17. The tang-like ends of the spring 30 frictionally engage the upper and lower walls 19, 19'. Moving the lever mechanism 18 into an extended position results in the removal of any remaining amount of the displacement of plate 17, and firmly secures the rod 10 against the respective opposite support surfaces.

Additionally, in the preferred embodiment of the invention, the outer and inner rod sections 12 and 14 contain end caps or covers 32 and 34 to provide a friction surface against the surfaces or walls between which the rod 10 is to placed. The covers 32 and 34 should be made out of a flexible material, such as rubber or one with polyvinyl chloride characteristics which will provide a friction surface made of a compressible composition.

FIG. 4 shows the elements of the invention in exploded view. The inner rod section 14 is inserted between the folded walls 16, 16' of the outer rod section 12 as are the locking plate 17 and the spring 30. The tang-like ends of the spring 30 contact and engage the inner surfaces, 19, 19' of the folded walls 16, 16' and deform into the generally concave configuration shown in FIG. 2. Once the inner rod section 14 is inserted into the outer rod section 12, the sections 12 and 14 still may be extended in a lengthwise direction. The deformation of the spring 30 only prevents the rod sections 12 and 14 from being collapsed. Once the two rods reach the desired length, they should not be drawn apart any further, and the lever mechanism 18 is moved into the extended position as shown in FIG. 2.

The present invention may be embodied into other specific forms without departing from the spirit or essential attributes thereof, and accordingly reference should be made to the appended claims, rather than to the foregoing specifications, as indicating the scope of the invention.

I claim:

1. A bracketless extension rod including a locking mechanism for holding the rod in place between two opposing support surfaces comprising:

(a) inner and outer telescoping rod sections, said outer rod section including channel means for receiving said inner rod section, said channel means including at least two opposing walls of said outer rod section;

(b) a locking plate slidably received within said channel means;

(c) tang means affixed to said locking plate, said tang means permitting the locking plate to move relative to said outer rod section only in the direction of extension of the rod by engagement with said opposing walls; and (d) an extendable lever mechanism including two lever arms pivotally attached to each other intermediate the locking plate and the inner rod section and operatively attached to said inner rod section and to said locking plate; said lever mechanism being operative when extended to place said inner and outer rod sections in compression between said two opposing support surfaces.

2. The extension rod of claim 1, wherein said tang means comprises an elongated spring extending between said two opposing outer rod section walls and being of greater length than the distance between said two outer rod section walls, whereby said spring deforms for engagement with said outer rod section walls to permit movement of the rod sections only in the direction of extension.

3. The extension rod of claim 2, wherein said tang means further comprises an elongated flat spring affixed to the distal end of said locking plate and is deformed with a concave surface facing away from the inner rod section.

4. The extension rod of claim 3, wherein the extendable lever mechanism is pivotably attached at one end to the inner rod section and pivotably attached to the locking plate at the opposite end.

5. The extension rod of claim 4, wherein said lever mechanism further comprises a thumb piece formed on one of the arms, whereby applying pressure on said thumb piece causes said lever mechanism to be extended.

6. The extension rod of claim 1, wherein said lever mechanism is entirely positioned within the channels of said outer rod section.

7. A bracketless extension rod including a locking mechanism for holding the rod in place between two opposing support surfaces, comprising:

(a) inner and outer telescoping rod sections, said outer rod section including at least two opposing walls;

(b) a locking plate slidably received within said outer rod section;

(c) tang means affixed to said locking plate, said tang means permitting the locking plate to move relative to said outer rod section only in the direction of extension of the rod by engagement with said opposing walls; and (d) an extendable lever mechanism including two lever arms pivotally attached to each other intermediate the locking and the inner rod section and operatively attached to said inner rod section and said locking plate; said lever mechanism being operative when extended to place the said inner and outer rod sections in compression between said two opposing support surfaces.

8. The extension rod of claim 7, wherein said tang means comprises an elongated spring extending between said two opposing outer rod section walls and being of greater length than the distance between said two outer rod section walls, whereby said spring deforms for engagement with said outer rod section walls to permit movement of the rod sections only in the direction of extension.

9. The extension rod of claim 8, wherein said tang means further comprises an elongated flat spring affixed to the distal end of said locking plate and is deformed with a concave surface facing away from the inner rod section.

10. The extension rod of claim 7, wherein said telescoping inner and outer rod sections are flat in shape, and said opposing walls are formed by opposing channels extending along the opposite elongated sides of said outer rod section.

11. The extension rod of claim 7, wherein said lever mechanism is entirely positioned within the channels of said outer rod section.

* * * * *